US005676835A

United States Patent [19]

Derton et al.

[11] Patent Number: 5,676,835

[45] Date of Patent: Oct. 14, 1997

[54] HORIZONTAL VIBRATORY CENTRIFUGE

[76] Inventors: Harry E. Derton, 2202 Stonegate Dr., Dupo, Ill. 62239; Dewey M. Cope, 6014 Willow Bend, St. Louis, Mo. 63123

[21] Appl. No.: 287,494

[22] Filed: Aug. 8, 1994

[51] Int. Cl.[6] ..... B04B 3/06; B04B 7/08

[52] U.S. Cl. ..... 210/370; 210/380.3; 210/360.1; 210/385; 494/36; 494/47; 494/48

[58] Field of Search ..... 210/360.1, 384, 210/385, 370, 380.3; 494/36, 47, 48

[56] References Cited

U.S. PATENT DOCUMENTS

| | | |
|---|---|---|
| 1,842,464 | 1/1932 | Ter Meer . |
| 2,861,691 | 11/1958 | Linke . |
| 2,872,045 | 2/1959 | Wirth . |
| 2,991,887 | 7/1961 | Wirth . |
| 3,133,879 | 5/1964 | Becker . |
| 3,182,802 | 5/1965 | Gooch . |
| 3,263,815 | 8/1966 | Golucke . |
| 3,864,256 | 2/1975 | Hultsch . |
| 4,135,659 | 1/1979 | Derton et al. . |
| 4,922,625 | 5/1990 | Farmer . |
| 4,961,722 | 10/1990 | Taylor et al. . |

FOREIGN PATENT DOCUMENTS

| | | |
|---|---|---|
| 235684 | 12/1959 | Australia . |
| 1018797 | 10/1957 | Germany . |
| 1022526 | 1/1958 | Germany . |
| 1039452 | 9/1958 | Germany . |
| 1039942 | 9/1958 | Germany . |
| 1061697 | 7/1959 | Germany . |
| 1075049 | 2/1960 | Germany . |
| 1076043 | 2/1960 | Germany . |
| 1137995 | 10/1962 | Germany . |
| 1183022 | 12/1964 | Germany . |
| 751295 | 6/1956 | United Kingdom . |
| 791488 | 3/1958 | United Kingdom . |

OTHER PUBLICATIONS

Wemco Vibrating Centrifuge pamphlet Copyright 1974 by Envirotech Corporation.

Wedag Vibrating Screen–Type Centrifuge –McNally Pittsburg Mfg. Corp.

2 pages on Bird Continuous Solid Bowl Centrifugal.

7 pages on Wemco Centrifuges.

*Primary Examiner*—Thomas M. Lithgow

[57] ABSTRACT

A horizontal screen separator of the present invention includes a base having a housing mounted thereon which contains an horizontal screen basket for receiving product to be dried. The basket is rotatably and vibrationally driven to dry the product. The separator includes two motors, one to impart rotational motion to the basket and the other to impart vibrational motion to the basket. The basket is rotatably fixed to a shaft driven by the rotating motor. The vibratory motor drives a shaft, operative contact with the rotating shaft, having an eccentric mounted thereon. The vibratory motor drives the vibratoy shaft to induce vibration in the basket. The basket also includes a lip or extension formed from screen as a right cylinder to increase the drying time of the product.

16 Claims, 6 Drawing Sheets

HORIZONTAL VIBRATORY CENTRIFUGE

BACKGROUND OF THE INVENTION

This invention relates to centrifugal separators, and, in particular, to a centrifugal separator which incorporates vibratory motion.

Centrifugal separators or centrifuges are generally used to separate or remove liquid from solids, such as coal, ore, or small parts. There are two basic types of screen centrifuges presently in use: screen-scroll and vibratory. The screen-scroll separator is a higher G (centrifugal force) machine that controls the flow of solids over a screen surface with a scroll or auger type of conveyor. Liquids are forced off the solids' surfaces and through the screen by centrifugal forces. The vibratory centrifuge is a low G machine that conveys solids over a screen surface with oscillating or vibratory motion. Both machines are best suited for a certain range of particle sizes and both have inherent advantages and disadvantages.

The screen-scroll centrifuge is capable of much higher G's under most conditions and, as a result, will provide more efficient dewatering (or drying). However, the flights or conveyors force the particles being centrifuged to form thin ribbons along each flight. Due to high exposure of all the particles to the screen, most small particles that will pass through the screen's openings will go through. This is especially true when a large amount of water is contained in the feed. The high G's combined with the loss of fine or small particles produces a very dry product with a poor recovery.

The normal vibratory centrifuge cannot be operated at high G's due to its limiting vibratory conveying capacity. Due to a thick bed that is maintained on the screen surface there is not much loss of solids through the screen openings. This is advantageous in that it makes the vibratory unit a higher recovery device, and thus more efficient machine. However, the thick bed also reduces the drying or dewatering that occurs. Thus, the current vibratory machines provide high recovery efficiency, but will not remove as much water or liquids as will the screen-scroll machines.

All screen type centrifuges have a loss of fine particles that simply wash through the screen. Solid bowl centrifuges are more efficient in the recovery of fines because they serve as a settling area that forces solids or heavies to the outer wall to be conveyed out over a sloped area. Later designs have included a screen at the end of the sloped area to enhance dewatering of solid particles, such as coal. Solids discharged through the screen are recirculated into the solid bowl portion of the centrifuge and, therefore, the solid bowl centrifuges give a very high recovery. However, the solid bowl centrifuges are expensive to obtain, are expensive to operate, and require a larger amount of power than the screen centrifuges.

SUMMARY OF THE INVENTION

One object of the present invention is to provide a screen separator for separating solid particles from water.

Another object is to provide such a separator which will have a high recovery rate.

Another object is to provide such a separator which will deliver a substantially dry product.

Another object is to provide a filter media bed that will allow the addition of fine particulates, such as froth flotation, over the bed to promote dewatering while retaining fine solids.

Another object is to provide such a separator which employs both centrifugal and vibratory motion.

Another object is to provide such a separator which is less expensive to produce and operate than current high recovery separators.

These and other objects will become apparent to those skilled in the art in light of the following disclosure and accompanying drawings.

In accordance with the invention, generally stated, a horizontal screen separator of the present invention includes a base having a housing mounted thereon which contains a horizontal screen basket for receiving product to be dried. The basket is rotatably and vibrationally driven to dry the product. The separator includes two motors, one to impart rotational motion to the basket and the other to impart vibrational motion to the basket. The basket is rotatably fixed to a shaft driven by the rotating motor. The vibratory motor drives a shaft which is in operative contact with the rotating shaft and which has eccentric weights mounted thereon. The vibratory motor drives the vibratory shaft to induce vibration in the basket. The shafts are preferably driven by pulley and belt systems. To compensate for stretching of the pulleys, the motors are adjustibly mounted to the base. One of the motors is slidably mounted to the base for horizontal movement, and the other is mounted for vertical adjustments.

The basket also includes a lip or extension formed from screen as a right cylinder to better control the bed depth and to increase the drying time of the product. The horizontal screen separator includes a screen basket, the basket includes a base, and a screen, which is secured to the base, and the screen having a generally frustoconical shape, with the axis of the basket lying along a generally horizontal line. It is this screen basket that is both rotated and oscillated simultaneously, during the separation process. The separator includes its screen that forms an included angle lying on a range from about 14° to 25° from the horizontal axis, and it includes its screen extension, as previously reviewed, at the larger end of the screen that is remote from the base. The screen extension is formed generally as a short right-angled cylinder. The separator further includes a rotating motor, that rotates the screen, the motor including a shaft having a pulley mounted on an end thereof, the rotating shaft having a second pulley mounted on that opposite end thereof, and an endless belt extending around said pulleys so that said motor can drive said rotating shaft, and transmit from 250 to 700 G's of centrifugal force to the material being processed. In addition, as previously explained, the oscillating means of the device includes rotatable eccentrics, and the eccentrics are mounted to at least one vibratory shaft which extends in an angle to the rotating shaft, said vibratory shaft being adjacent said rotating shaft, and said vibratory shaft being rotatably driven to rotate the eccentrics to induce oscillatory motion in the rotating shaft. Through this manner the vibratory means conveys approximately 10 to 30 G's of force, or exceeding thereof, to accomplish the proper conveyance of the materials as it is being processed by the separator. In addition, that right-angled cylindrical extension portion of the screen increases the overall solids retention time, within the screen and basket, during separation, thus improving the dewatering efficiency and increasing the bed depth, of the material, as it forms upon the screen, during the filtering processing, and actually improves the filtering bed and pad for the screen through the use of the material itself to act as a filter for an overlay of small particulate material that achieves something similar to a froth flotation. Solutions containing fine solids can be applied over the formed filter media or bed, to filter out the solids while allowing the liquids to pass through the bed, and the screen of the basket, under centrifugal force. A feed tube may be used to apply the froth and fines to the bed to achieve the more efficient dewatering.

DESCRIPTION OF THE PREFERRED EMBODIMENT

Figure 1:
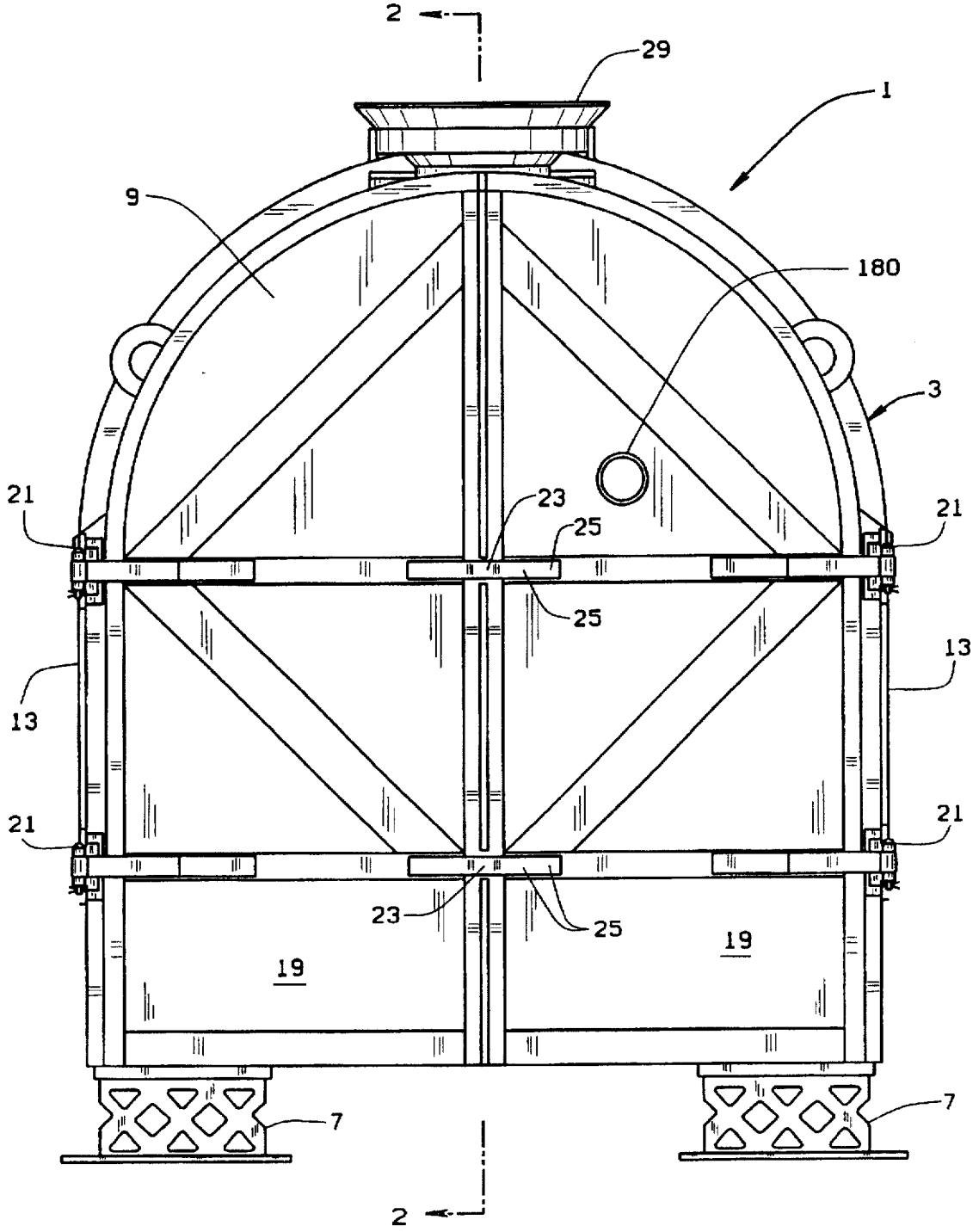
FIG. 1 is a front elevational view of a separator of the present invention.

Referring now to the FIG. 1, reference numeral 1 indicates one illustrative embodiment of a separator of the present invention. Separator 1 includes a separator housing 3 which rests upon a base 5. Base 5 rests on a series of vibration and noise dampening cushions 7 that support the housing above the floor of an industrial plant in which the separator is located. The cushions 7 may be made of any type of durable rubber or other resilient polymer that effectively dampens the transfer of any vibrations to the floor or the surrounding vicinity of the plant, and also lessens the noise associated with the operation of the separator.

The separator housing 3 has a front 9, back wall 11, sides 13, and a top 15. A separator assembly 17 is rotatably mounted in housing 3. The front of housing 3 defines a pair of doors 19 which are pivotally mounted to sides 13 by hinges 21. The doors, which allow access to the interior of housing 3 for collection of product, are maintained closed by a latch 23, which is secured to one of the doors, and screws or bolts 25 which extend through a free end of the latch into the second door.

The doors 19 are spaced forwardly of base 5 and extend the full height of the separator 1. The area between the base and the door thus defines a collection area 27. A chute 29 extends out the top of collection area 27 to allow for the entry of product to be dried into assembly 17. A handle 31 is formed at the top of the chute and provides a means whereby the chute 29 may be lifted and moved with the aid of a crane, for example. A feed tube 180, which may be shifted coaxially within the basket, applies froth and fine particulates to the filter bed of material to achieve more efficient filtering and dewatering of the product during separation.

Figure 2:
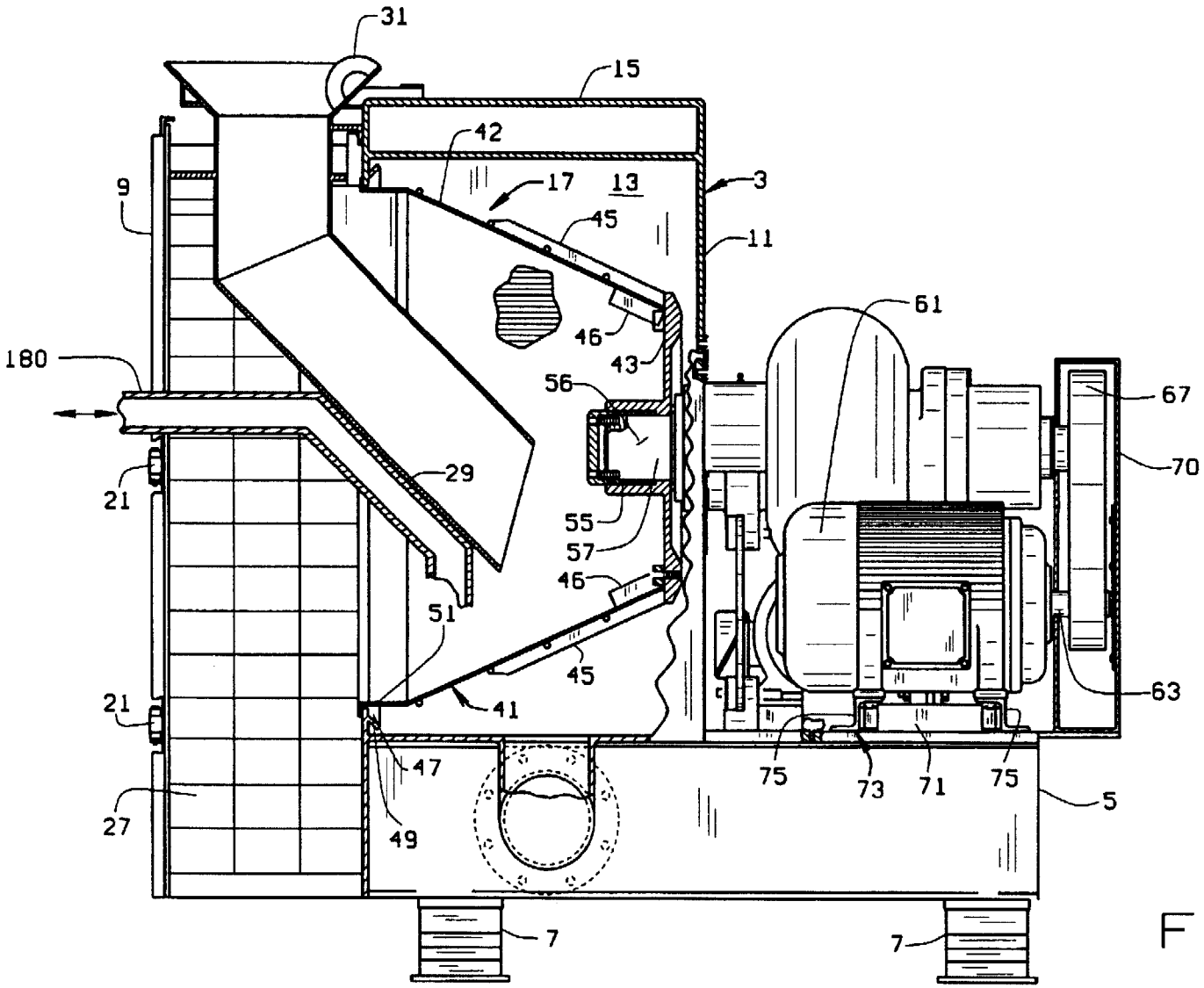
FIG. 2 is a cross-sectional view taken along line 2—2 of FIG. 1.
Figure 3:
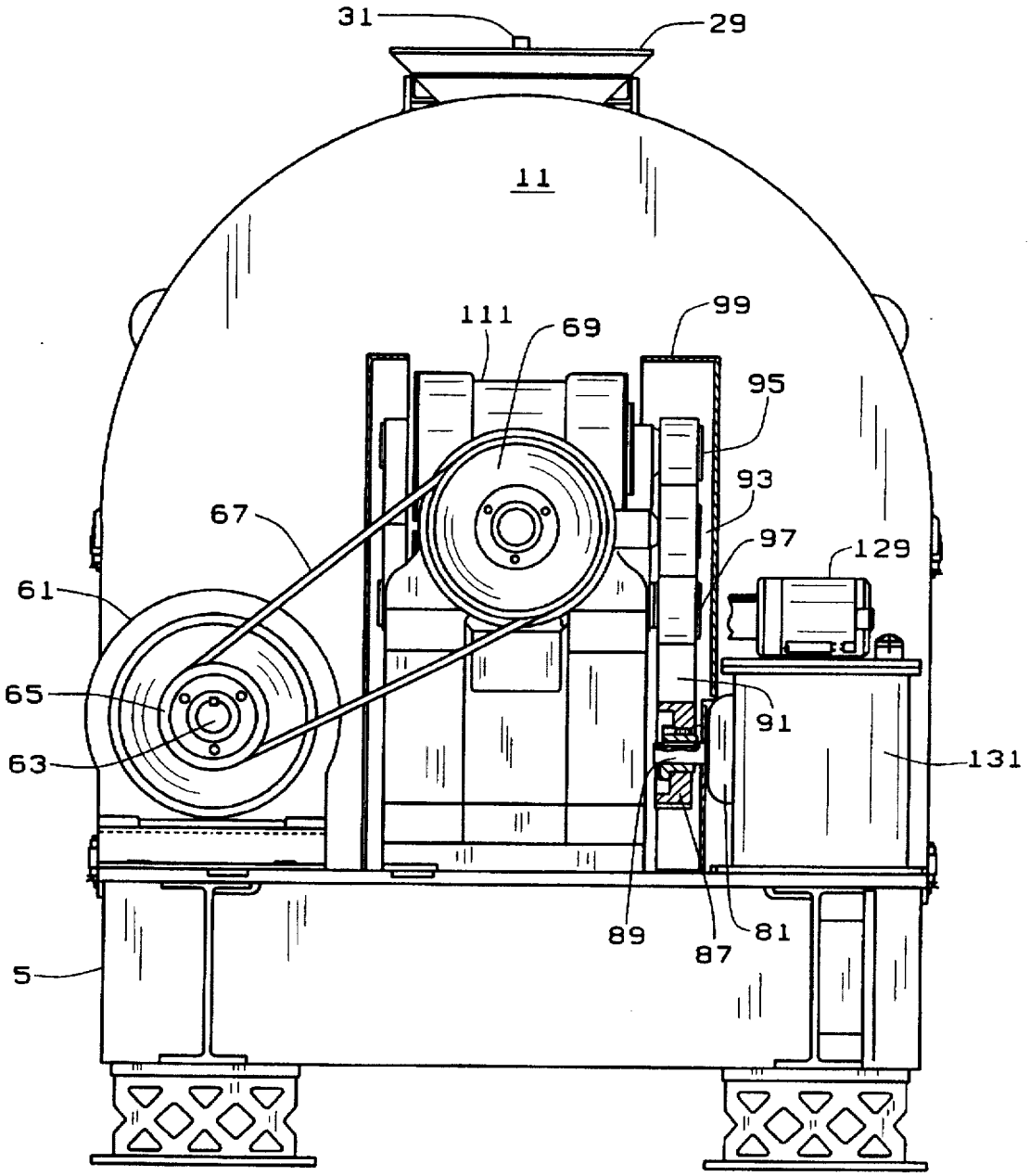
FIG. 3 is a back elevational view of the separator.

Turning to FIG. 2, separator assembly 17 includes a basket 41 formed of a generally frustoconically shaped screen 42. The screen 42 is mounted at its back to a base 43 and along its sides to a plurality of spaced ribs 45 which extend diagonally away from base 43 on an outer surface of the screen. Clamps 46 are secured to the inner surface of screen 42 adjacent base 43 to further secure the screen to the base. Clamps 46 are not as long as ribs 45. At its front, basket 41 has a circular, peripheral screen extension 47 which moves inside the sloped flange or lip 49. Lip 49 provides a guide which collects liquids and guides them into area 13. A generally right cylindrical screen section 51 extends outwardly from the end of screen 41 above the collection area adjacent 27.

Screen base 43 includes a centrally located inwardly projecting boss 55 which receives an end 56 of a rotatable shaft 57. Base 43 is rotatably fixed to shaft 57 so that the shaft will rotate or spin the separator assembly 17 when the shaft is rotated.

A rotation motor 61 is mounted on base 5 behind housing wall 11. Motor 61 has an output shaft 63 having a pulley 65 fixed thereon. An endless belt 67 is mounted about pulley 65 and extends around a second pulley 69. Pulley 69 is mounted to an end of shaft 57 opposite screen base 43 so that separator assembly 17 will be rotated by motor 61. Belt 67 is preferably enclosed in a belt housing 70.

Motor 61 is preferably mounted on a pull bar assembly 71 which is slidably received in a slide 73. Slide 73 includes two spaced-apart, generally S-shaped brackets 75 which are secured to base 5 with bolts or the like. The ability to slide motor 61 allows for adjustment of the motor position to compensate for stretching of the belt 67 and for replacement of the belt.

Figure 4:
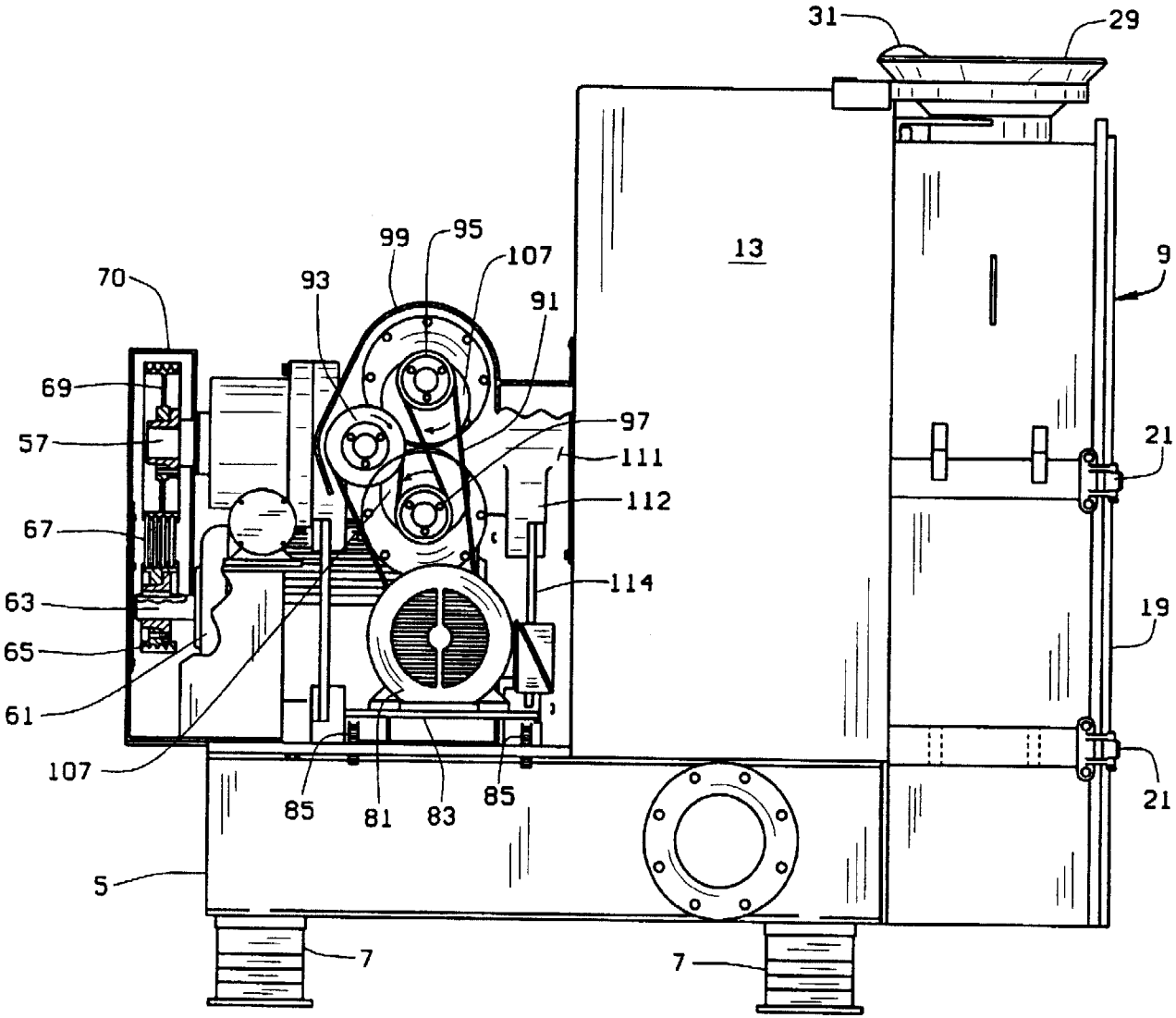
FIG. 4 is a side elevational view.

Turning to FIG. 4, a vibratory motor 81 is mounted on base 5. Preferably, motor 81 is mounted to a mounting plate 83 which is adjustibly mounted to base 5 by adjustable bolts 85. Motor 81 drives a pulley 87 which is mounted to the end of the motor's shaft 89. An endless belt 91 extends around pulley 87, an idler pulley 93, and two vertically spaced pulleys 95 and 97. The pulleys 87, 93, 95, and 97 and belt 91 are enclosed by a belt guard 99.

Figure 5:
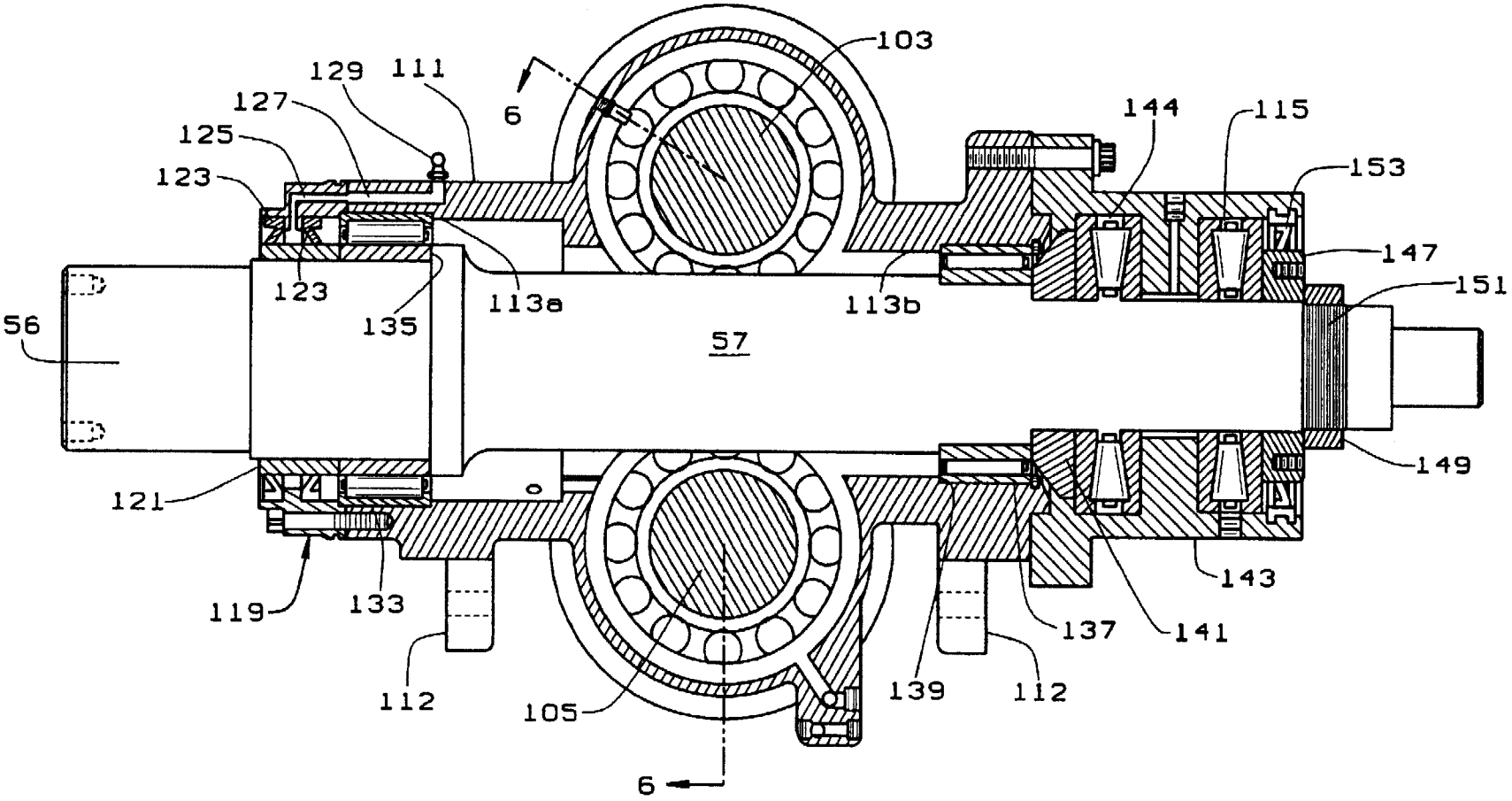
FIG. 5 is a cross-sectional view of a drive assembly for introducing vibration into the separator.
Figure 6:
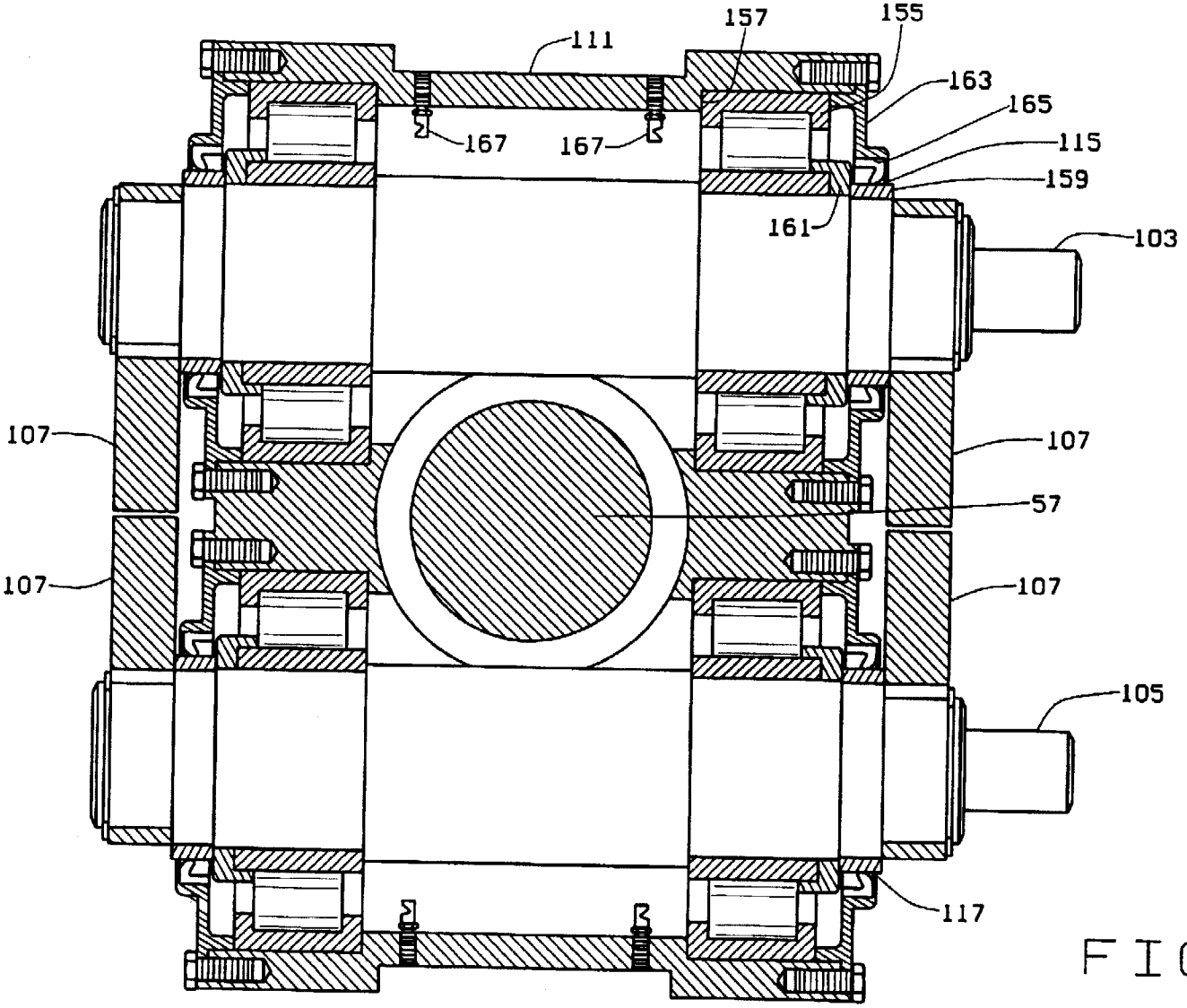
FIG. 6 is a cross-sectional view of the drive assembly taken along line 6—6 of FIG. 5.

Pulleys 95 and 97 drive two shafts 103 and 105 which, as best seen in FIGS. 5 and 6, extend perpendicularly to the shaft 57 which is connected to the separator assembly 17. As can be seen, shafts 103 and 105 are positioned on opposite sides of shaft 57 and are in operative contact with shaft 57, as will be explained below. Shafts 103 and 105 each have a pair of eccentric weights 107 fixed on the ends thereof. Retaining rings are used to secure the weights to the shafts. Preferably, the eccentric weights of the two shafts are 180° out of phase with each other. In other words, as seen in FIG. 6, when the weight of shaft 103 extends downwardly, the weight of shaft 105 extends upwardly. The weights of a single shaft, however, are mounted to the shaft in phase with each other—both eccentrics extend in the same direction. When shafts 103 and 105 are driven by motor 81, the weights 107 will create an oscillating motion in the shafts 103 and 105. Because the weights are out of phase from each other by 180°, the oscillation of the two shafts will be out of phase by 180°. Because the shafts are in contact with shaft 57, the shafts 103 and 105 will induce a vibratory motion in shaft 57 to vibrate the separator assembly 17.

The shafts 57, 103 and 105 are enclosed by a drive housing 111. Housing 111 includes downwardly extending flanges 112. Leaf springs 114 are connected to and extend between flanges 112 and motor base 5 to secure the housing 111 to the base. Housing 111 is shown in detail in FIGS. 5 and 6. The housing includes three pairs of opposing ports 113, 115, and 117, through which shafts 57, 103, and 105 are journaled, respectively. End 56 of shaft 57 is received in a socket head 119 which is secured to housing 111 at an opening 113*a*. A sleeve 121 journals shaft 57 at the outer edge of head 119. A pair of spaced oil seals 123 surround sleeve 121. Grease flow path 125 opens into the space between seals 123 and is in fluid communication with grease flow path 127 in housing 111. A connector 129 is provided on the surface of housing 111 to provide grease lubication for seal 123. Shaft end 56 is also journaled through a second needle bearing 133 at the outer end of opening 113*a*. Bearing 133 is seated against a shoulder 135 formed on shaft 57.

Another needle bearing 137 is formed at the opening 113b. Bearing 137 is seated against a shoulder 139 formed in housing 111 and a spacer ring 141. Spacer ring 141 is journaled on shaft 57. Bearing housing 143 contains two spaced-apart tapered roller thrust bearings 144 and 145. A retaining ring 147 and lock nut 149 hold bearings 144 and 145 in bearing housing 143. Shaft 57 has threads 151 on which lock nut 149 is threaded. An oil seal 153 is provided in retaining ring 147 to prevent lubricating fluid from exiting housing 111.

In FIG. 6, the bearing arrangement for shafts 103 and 105 can be seen. The ends of the shaft are identically journaled, and thus only one end of shaft 103 will be discussed. The ends of the shafts are journaled through roller bearings 155 which are seated against a shoulder 157 formed in housing 111. A seal wear ring 159 surrounds shafts 103 and 105. An angle ring 161 is sandwiched between an outer edge of bearing 157 and ring 159 to hold an inner race of bearing 157. An end cap 163 is secured to housing 111 and holds the outer race of the bearing against shoulder 157. A groove is defined between end cap 163 and ring 159 and receives an oil seal 165.

A pair of fluid nozzle jets 167 are provided between shoulders 157. Jets 167 are connected to oil pump 129 to provide lubrication for the bearings and shafts within housing 111. The various oil seals prevent leakage of oil from the housing.

Motor 61 rotates shaft 57 to provide rotational motion to the basket 41. Motor 81 drives shafts 103 and 105 which, as described above, induce an oscillation in shaft 57, to vibrate basket 41. When material, such as coal, is introduced into basket 41, it is, thus, both vibrated and rotated. Because the basket is both vibrated and rotated, the vibration and rotational speeds can be adjusted to maintain a thicker bed to reduce the loss of fines. However, the basket can be rotated at speeds higher than standard vibratory screen centrifuges to increase drying efficiency. In this manner, the separator 1 has a high recovery of a dry product. Further, the screen extension 51 at the end of basket 41 increases the residence time of the material on the screen. This further increases the drying or dewatering ability of the separator.

As can be appreciated, the separator 1 produces a dry product with a high recovery. Variations within the scope of the appended claims may be apparent to those skilled in the art. For example, shaft 57 could be driven directly by motor 61. The various pulleys could be replaced with gears. A single motor could be used to drive all three shafts. Eccentrics could be provided on shaft 57 to induce oscillating motion in that shaft, which would then be passed onto the basket. This would eliminate the need for shafts 103 and 105 and motor 81. These examples are merely illustrative.

We claim:

1. A horizontal vibratory screen separator for continuously removing liquids from a mixture of granular or fibrous solids, such as coal or paper pulp products, under high forces; the separator including:

a feeder for introducing a feed mixture of liquid and solids into the separator;

a collector for collecting separated product;

a screen basket which receives the feed mixture, said basket including a basket base and a screen which is secured to a first side of said basket base, said screen having a generally frustoconical shape, the axis of said basket lying along a generally horizontal line;

a separator shaft extending from a second side of said basket base;

at least one vibratable shaft in operative contact with said separator shaft, said at least one vibratable shaft being capable of inducing vibrations in said separator shaft as said vibratable shaft is rotated;

a first motor mounted on a separator base and operatively connected to said separator shaft for rotating said basket, said first motor rotating said screen basket at a rate sufficient to transmit about 250 G's to about 700 G's of centrifugal force to the product being separated; and a second motor mounted on said separator base and operatively connected to said at least one vibratable shaft to rotate said vibratable shaft for vibrating said basket, said second motor rotating said vibratable shaft at a rate sufficient to induce about 10 G's to about 30 G's of centrifugal force for conveying the product being separated along the screen basket.

2. The separator of claim 1 wherein said screen of the basket forms an included angle arranged approximately between 14° to 25° from the horizontal or axis of the screen basket, in the formation of its generally frustoconical shape.

3. The separator of claim 1 and including a screen extension, said screen extension being formed generally as a right angled cylinder, and extending from an end of said frustoconical screen.

4. The separator of claim 1 wherein said first motor is mounted to a slide which is slidably mounted to said base, said slide allowing for horizontal motion of said motor relative to said separator base.

5. The separator of claim 1 wherein said at least one vibratable shaft has an eccentric mounted thereto.

6. The separator of claim 1 including two of said vibratable shafts in spaced apart relation, said vibratable shafts being positioned on opposite sides of said separator shaft.

7. The separator of claim 6 wherein the eccentrics of each said vibratable shafts induces forces that are aligned along the axis of the said rotating shaft.

8. The separator of claim 7 wherein the eccentrics of each vibratable shaft are 180° out of phase and rotated in opposite directions.

9. The separator of claim 1 wherein each said vibratable shaft extends at right angles to said separator shaft.

10. The separator of claim 1 wherein said first motor drives a pulley, said separator shaft having a pulley at one end thereof, and endless belt extending around said pulleys.

11. The separator of claim 10 wherein said first motor is adjustably mounted to said separator base.

12. The separator of claim 11 wherein said second motor is mounted to a motor base which is movably secured to said separator base for vertical movement, said second motor being movable vertically relative to said separator base.

13. A horizontal screen separator for dewatering a feed suspension through a formed filter bed including:

a separator base;

a housing mounted on said separator base;

a rotatable horizontal screen basket contained in said housing, said basket receiving the feed suspension, said basket including a basket base and a screen which is secured to said basket base, said screen having a generally frustoconical shape, the axis of said basket lying along a generally horizontal line;

a screen extension at an end of said basket remote from said base, said extension being formed generally as a right cylinder;

a feed suspension inlet for introducing said feed suspension to be dewatered into said screen basket;

a source of froth and fine particles; and an inlet for supplying said froth and fine particles into said screen basket so as to increase the efficiency of the separator.

14. The separator of claim 13 including means for vibrating said basket.

15. The separator of claim 14 including a rotatable shaft operatively connected to said basket base for rotating said basket and a rotating motor operatively connected to said rotatable shaft to rotatably drive said shaft; and said means for vibrating said basket including eccentrics mounted on a second rotatable shaft, said second rotatable shaft being rotatable to produce an oscillating motion, said second rotatable shaft being operatively connected to said first rotatable shaft to induce a vibratory motion in said basket and a vibratory motor operatively connected to said second shaft for driving said second shaft.

16. The separator of claim 13 wherein said feed tube is shiftably mounted coaxially within the basket when depositing said froth and fine particulates therein.

* * * * *